United States Patent [19]

Niimi et al.

[11] 3,962,385

[45] June 8, 1976

[54] METHOD FOR MANUFACTURING SPHERICAL HOLLOW PARTICLES

[75] Inventors: Itaru Niimi, Nagoya; Kametaro Hashimoto, Toyota; Kenji Ushitani, Toyota; Masashi Shibata, Toyota; Yoshitaka Takahashi, Toyota, all of Japan

[73] Assignee: Toyota Jidosha Kogyo Kabushiki Kaisha, Toyota, Japan

[22] Filed: July 16, 1973

[21] Appl. No.: 379,828

[30] Foreign Application Priority Data

July 17, 1972 Japan ..... 47-71447

[52] U.S. Cl. ..... 264/11

[51] Int. Cl.[2] ..... B01J 2/02

[58] Field of Search ..... 264/11

[56] References Cited

UNITED STATES PATENTS

| | | | |
|---|---|---|---|
| 2,636,219 | 4/1953 | Beamer et al. | 264/111 |
| 3,551,532 | 12/1970 | Laird | 264/111 |

FOREIGN PATENTS OR APPLICATIONS

| | | | |
|---|---|---|---|
| 553,672 | 6/1943 | United Kingdom | 264/11 |

*Primary Examiner*—Robert F. White
*Assistant Examiner*—J. R. Hall
*Attorney, Agent, or Firm*—Brisebois & Kruger

[57] ABSTRACT

A method for manufacturing spherical hollow particles by providing a large number of individual linear water jets arranged in a ring and converging at a single point, and passing a molten metal through this ring of water jets and converging point.

8 Claims, 8 Drawing Figures

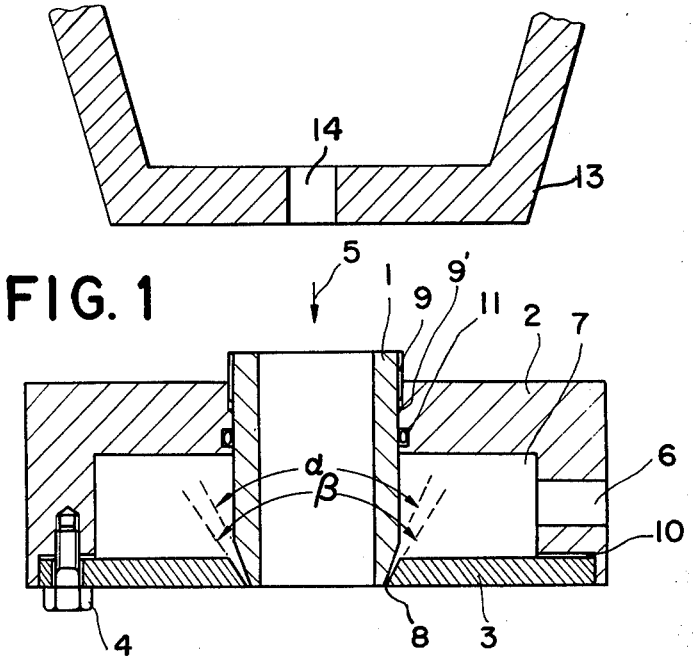
FIG. 1
FIG. 2
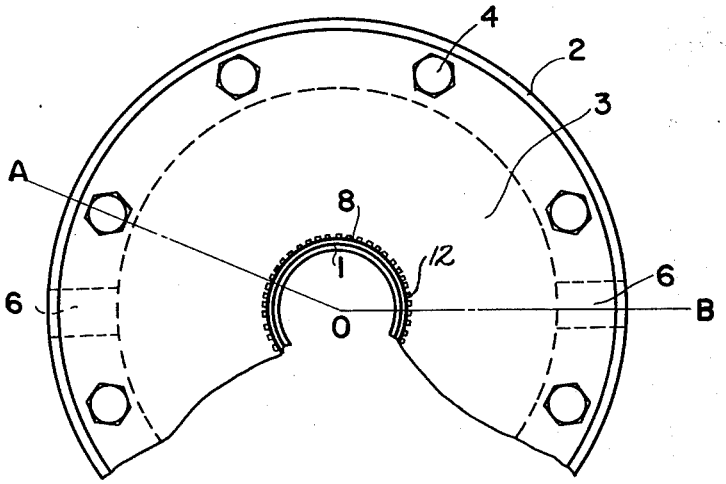

METHOD FOR MANUFACTURING SPHERICAL HOLLOW PARTICLES

BACKGROUND OF THE INVENTION

At present, hollow particles made of such ceramic materials as carbon, alumina or glass are available and some cases are known of hollow particles of aluminum having been produced, though not on a mass-production scale.

Applicant is, however, aware of no example of spherical hollow particles of iron or any iron alloy having ever been produced on an industrial scale with the size, specific gravity and wall thickness adequately controlled.

SUMMARY OF THE INVENTION

The present invention relates to a method and apparatus for commercially manufacturing hollow spherical particles from iron or iron alloys.

DESCRIPTION OF THE DRAWINGS

FIG. 1 is a sectional view of a water jet nozzle for manufacturing spherical hollow particles according to the present invention taken along the line A—B of FIG. 2, with the bottom of a crucible shown in section above it;

FIG. 2 is a partial bottom plan view of this water jet nozzle;

Figure 3:
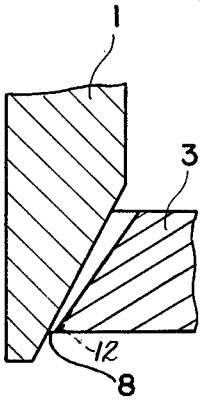
FIG. 3 is an enlarged sectional view of the nozzle gap showing one of a set of small slots provided in a ring.

In the FIGURES, reference numeral 1 indicates the core; 2 the housing; 3 the ring; 5 the molten metal; 6 the water supply hole; 8 the annular slit; 9 an adjusting screw; and 12 a slot.

DETAILED EXPLANATION OF THE INVENTION

According to the present invention, spherical hollow particles can be formed, depending on the quality of the molten metal, the pressure of the water flow in the jet and the impact between the water jet and the molten metal when a large number of linear water jets are arranged in a ring. These jets converge at a single point, and molten iron is passed in a small stream through this ring of water jets and the single point of convergence.

The invention will now be described with specific reference to the accompanying drawings.

FIG. 1 is a sectional view of a water jet nozzle for manufacturing spherical hollow particles from iron or an iron alloy. The water jet nozzle of FIG. 1 consists of the core 1, the housing 2, and the ring 3. The core 1 is a hollow cylinder with one end tapered on the outside and subtending the angle $\alpha$ while male screw threads 9 are formed on the outer surface of its other end. The core is so constructed that when it is screwed into the housing 2, the core can be vertically adjusted by rotating it in the housing 2 as permitted by the threads 9. Mating threads 9′ are provided at the top of the housing 2 to receive the male threads 9 on the core 1. Two water supply holes 6 may also be provided in the sides of the housing. (See FIG. 2.) The ring 3 has a centrally located round hole subtending a slightly larger angle $\beta$ than the angle $\alpha$ of the core 1. This ring is so constructed that it can fit around the end of the core 1 and can be attached to the housing 2 by means of the bolts 4.

As shown in FIG. 2, a series of small slots 12 with a width of 0.1–0.5 mm and a depth of 0.05–0.3 mm are cut at equal intervals of 0.1–1 mm around the center hole in the ring 3. This slotted ring and a slotless smooth tapered portion of the core 1 have a common axis O and define an annular gap 8. This annular gap 8 may similarly be formed by cutting slots on the periphery of the tapered portion of the core 1 and combining this portion with a ring having a slotless smooth tapered portion.

Figure 4:
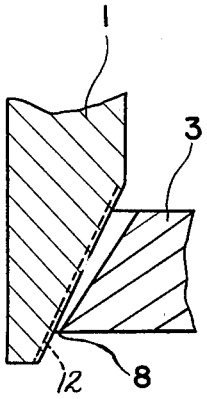
FIG. 4 is an enlarged sectional view of the nozzle gap showing one of a set of small slots provided in a core.
Figure 5:
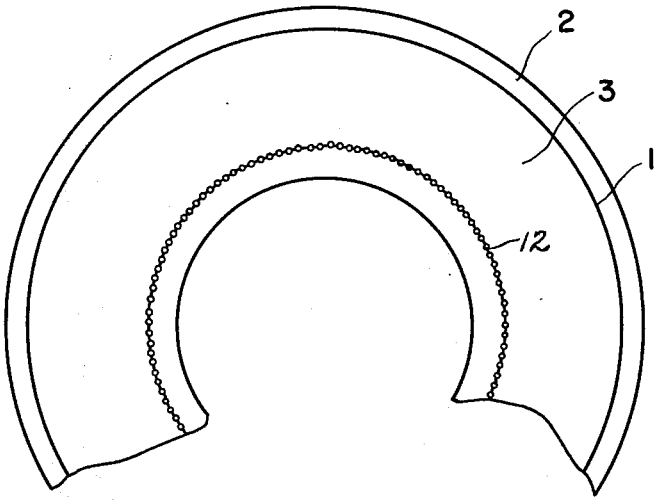
FIG. 5 is a partial bottom plan view of the nozzle showing a series of small orifices provided along the ring-core boundary.

FIG. 3 is an enlarged view showing one of the slots 12 cut into the ring 3, and FIG. 4 is an enlarged view showing a slot 12 cut into the core 1. An alternative arrangement is illustrated in FIG. 5 showing the nozzle bottom. In this embodiment small holes may be provided on the circumferential interface between the ring 3 and the core 1, which are tightly joined together, so that jets therethrough will converge to define an inverted cone.

Pressurized water is introduced through the water supply hole 6 of FIG. 1 and passes through the space 7 enclosed by the housing 2, the core 1 and the ring 3 to emerge from the annular gap 8 as an inverted cone of linear water jets. Since the inner surface of the ring 3 is provided with slots 12, the water flowing out between the smooth surface of the tapered portion of the core 1 and each slot 12 forms a fine line. The thickness of this fine line of water flow may be varied by adjusting the gap between the ring 3 and the tapered portion of the core 1 or by using a ring 3 with slots 12 of different widths and depths.

Meanwhile, the center hole of the core 1 is aligned with the center hole of the ring 3 so that the water is supplied uniformly around the annular gap. This is done by screwing the core 1 into the housing 2 and then fastening them together with bolts 4 while both are coaxially aligned.

Thus, the water jet from the annular gap 8 of the nozzle is uniformly distributed circumferentially of said gap and emerges as linear streams through the small slots 12 cut on the inside surface of the ring 3.

The material for the spherical hollow particles may be a molten iron or iron alloy comprising at least one constituent selected from among the group consisting of nickel 1–20%, copper 1–10%, graphite 0.1–5%, silicon 0.1–5%, sulphur 0.01–2%, phosphorus 0.01–2%, manganese 0.1–10%, chromium 0.1–5% and aluminum 0.005–3%; or any other molten metal of equivalent properties.

Such a molten metal is passed through a crucible 13 with a hole 14 at its bottom which is 2–10 mm in diameter to form a stream 2–10 mm in thickness, which falls through the center of the core 1 from the top of the nozzle in FIG. 1. Impingement of the water jet against the stream of molten metal breaks the molten metal into droplets, which form spherical hollow particles due to the combination of the water jet and molten metal according to the present invention. The spherical particles thus formed fall into water (not shown) provided beneath the nozzle and, after cooling, they are collected.

Molten metal, which has been dropped through the center of the core 1, passes through the linear water jet from the annular gap 8 and the molten metal is fragmented by the water, but water droplets are trapped in the droplets of molten metal. These water droplets break down through heat into $H_2$ and $O_2$ gases; and when graphite has been added to the metal before melting, the droplets react with C in the molten metal to produce CO and $CO_2$ gases. These $H_2$, $O_2$, CO, $CO_2$ and $SO_2$ gases produced through reaction between water and molten metal, together with the $H_2$, $O_2$ and $N_2$ gases which have been dissolved in the molten metal and are released upon solidification, cause the droplets of molten metal to expand from the inside, thereby forming hollow particles with an internal cavity. Meanwhile, the jets of water have a lower cooling capacity than a sheet of water would and accordingly, the cooling of the molten metal as it passes through the linear water flow is retarded. As a result, a droplet of molten metal, due to surface tension, assumes a spherical form. Thus, hollow particles can be produced. If a continuous sheet of water with uniform thickness were discharged from a nozzle consisting of a ring and a core with a smooth taper and no such slots as provided in the present invention, it would be hardly possible to produce hollow particles. As a result of the inverted conical convergence of the water flow through the nozzle of the present invention, droplets of fine molten metal flowing out of the crucible are caught by the inclined surface of the inverted cone of water thereby efficiently producing the hollow particles.

Next, details of the present invention will be given by describing specific examples of the process, but it goes without saying that the present invention is in no way limited in its principle and scope to the details of these examples. In the following description, weight is expressed in percentages.

EXAMPLE 1

Fifteen kilograms of electrolytic iron and cold-rolled steel plate to which 5% graphite as carbon has been added were melted and held at 1800°C. This molten metal was poured into a crucible to pass through a 5 mm in diameter hole at its bottom. The stream 5 of this molten metal was exposed to a water jet flowing at 55 l/min with a pressure of 10 kg/cm² from a nozzle tapered 40° at $\alpha$ and 45° at $\beta$ with the annular gap 8 set at 0.15 mm. Spherical hollow particles of iron measuring 0.5 mm to 15 mm in average diameter and 0.1 mm to 0.7 mm in wall thickness were produced.

EXAMPLE 2

Five percent graphite as carbon was added to 15 kilograms of electrolytic iron and cold rolled steel plate and the mixture melted and held at 1800°C. The molten metal was dropped through a bottom hole in a crucible which was 5 mm in diameter and the falling stream 5 of this molten metal was exposed to a water jet flowing at 55 l/min under a pressure of 30 kg/cm² from a nozzle tapered 40° at $\alpha$ and 45° at $\beta$ with the annular gap 8 set at 0.05 mm. Spherical hollow particles of iron ranging from 0.5 mm to 15 mm in average diameter and from 0.1 mm to 0.7 mm in wall thickness were produced.

EXAMPLE 3

Five percent graphite as iron was added to 15 kilograms of electrolytic iron and cold rolled steel plate and the mixture melted and held at 1800°C. The molten metal was dropped through a 9mm bottom hole in a crucible and the falling stream 5 of this molten metal was exposed to a water jet flowing at 55 l/min under a pressure of 10 kg/cm² from a nozzle tapered 40° at $\alpha$ and 45° at $\beta$ with the annular gap 8 set at 0.15 mm. Spherical hollow particles of iron ranging from 0.5 mm to 17 mm in average diameter and from 0.1 mm to 0.8 mm in wall thickness were produced.

EXAMPLE 4

Five percent graphite was added to 15 kilograms of electrolytic iron and cold rolled steel plate and the mixture melted and held at 1800°C. The molten metal was dropped through a 9 mm bottom hole in a crucible and the falling stream 5 of this metal was exposed to a water jet flowing at 55 l/min under a pressure of 30 kg/cm² from a nozzle tapered 40° at $\alpha$ and 45° at $\beta$, with the annular gap 8 set at 0.05 mm. Spherical hollow particles of iron ranging from 0.5 mm to 15 mm in average diameter and from 0.1 mm to 0.8 mm in wall thickness were produced.

EXAMPLE 5

Three percent graphite was added to 15 kilograms of electrolytic iron and cold rolled steel plate and the mixture melted and held at 1650°C. The molten metal was dropped through a 6 mm bottom hole in a crucible and the falling stream 5 of metal was exposed to a water jet flowing at 55 l/min under a pressure of 10 kg/cm² from a nozzle tapered 40° at $\alpha$ and 45° at $\beta$ with the annular gap 8 set at 0.15 mm. Spherical hollow particles of iron ranging from 0.5 mm to 18 mm in average diameter and from 0.2 mm to 1.0 mm in wall thickness were produced.

EXAMPLE 6

Three percent graphite was added to 15 kilograms of electrolytic iron and cold rolled steel plate and the mixture melted and held at 1650°C. The molten metal was dropped through a 6 mm bottom hole in a crucible and the falling stream 5 of metal was exposed to a water jet flowing at 55 l/min under a pressure of 30 kg/cm² from a nozzle tapered 40° at $\alpha$ and 45° at $\beta$ with the annular gap 8 set at 0.2 mm. Spherical hollow particles of iron ranging from 0.5 mm to 15 mm in average diameter and from 0.2 mm to 0.9 mm in wall thickness were produced.

EXAMPLE 7

Four percent graphite and 2.5% ferrosilicon were added to 15 kilograms of electrolytic iron and cold rolled steel plate, and the mixture melted and held at 1700°C. The molten metal was dropped through a 5 mm bottom hole in a crucible and the stream 5 of metal was exposed to a water jet flowing at 55 l/min under a pressure of 5 kg/cm² from a nozzle tapered 40° at $\alpha$ and 45° at $\beta$ with the annular gap 8 set at 0.3 mm. Spherical hollow particles of iron ranging from 0.5 mm to 15 mm in average diameter and from 0.1 mm to 0.6 mm in wall thickness were produced.

EXAMPLE 8

Three percent graphite and 2% manganese were added to 15 kilograms of electrolytic iron and cold rolled steel plate and the mixture melted and held at 1800°C. The molten metal was passed through a 5 mm bottom hole in a crucible and the falling stream 5 of metal was exposed to a water jet flowing at 55 l/min under a pressure of 10 kg/cm² from a nozzle tapered 40° at $\alpha$ and 45° at $\beta$ with the annular gap 8 set at 0.15 mm. Spherical hollow particles of iron ranging from 0.5 mm to 17 mm in average diameter and from 0.2 mm to 1.0 mm in wall thickness were produced.

EXAMPLE 9

Three percent graphite, 2.5% silicon, 0.5% phosphorus and 0.1% sulphur were added to 15 kilograms of electrolytic iron and cold rolled steel plate, the mixture was melted and held at 1800°C. The molten metal was passed through a 5 mm bottom hole in a crucible and the falling stream 5 of metal was exposed to a water jet flowing at 55 l/min under a pressure of 10 kg/cm² from a nozzle tapered 40° at $\alpha$ and 45° at $\beta$, with the annular gap 8 set at 0.15 mm. Spherical hollow particles of iron ranging from 0.5 mm to 18 mm in average diameter and from 0.1 mm to 0.7 mm in wall thickness were produced.

EXAMPLE 10

Three percent graphite, 2.5% silicon, 0.5% phosphorus and 0.1% sulphur were added to 15 kilograms of electrolytic iron and cold rolled steel plate, the mixture was melted and held at 1800°C. The molten metal was passed through a 9 mm bottom hole in a crucible and the falling stream 5 of metal was exposed to a water jet flowing at 55 l/min under a pressure of 20 kg/cm² from a nozzle tapered 40° at $\alpha$ and 45° at $\beta$ with the annular gap 8 set at 0.12 mm. Spherical hollow particles of iron ranging from 0.5 mm to 18 mm in average diameter and from 0.2 mm to 1.5 mm in wall thickness were produced.

Figure 6:
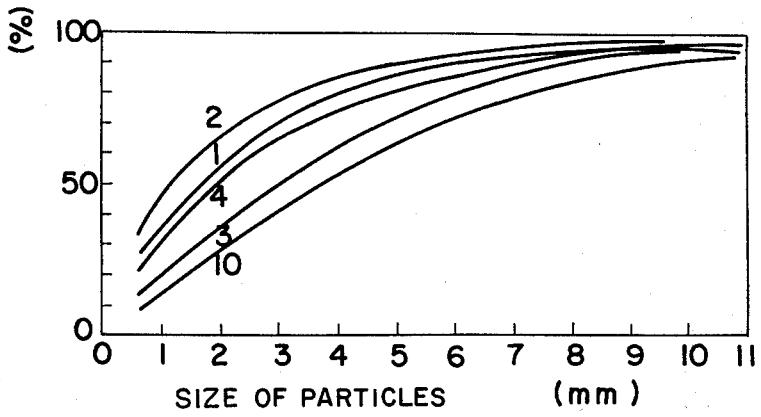
FIG. 6 is a graph illustrating the size distribution of the hollow iron particles, with the size of the particles in mm plotted along the abscissa and the percentage of particles no larger than that size plotted along the ordinate.
Figure 7:
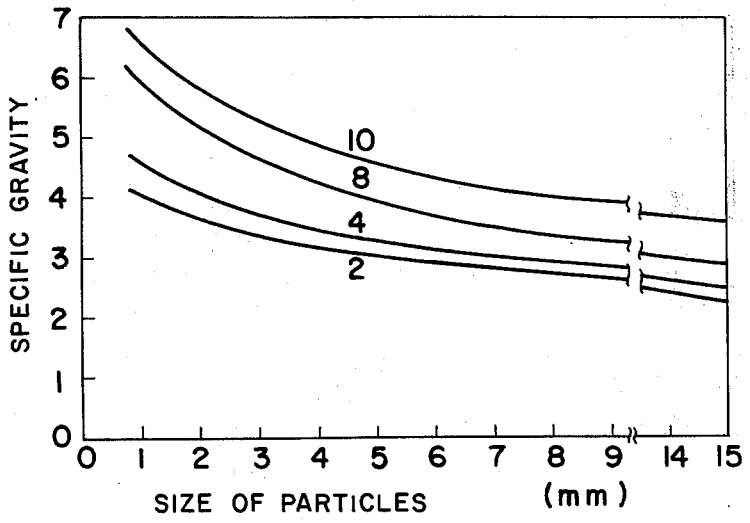
FIG. 7 is a graph illustrating the relationship between the diameter and specific gravity of the hollow iron particles; with the size in millimeters plotted along the abscissa and the specific gravity along the ordinate.
Figure 8:
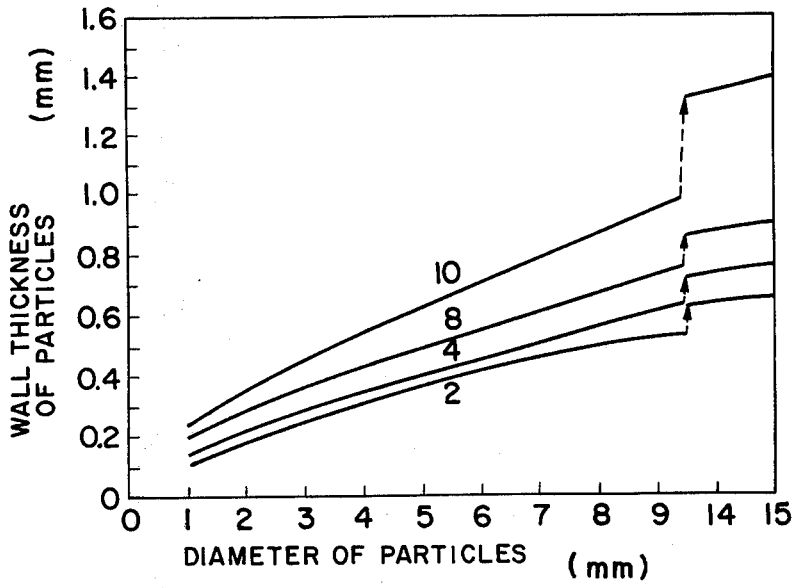
FIG. 8 is a graph illustrating the relationship between the diameter and the wall thickness of hollow iron particles, with the diameter along the abscissa and the wall thickness along the ordinate.

In each of FIGS. 6, 7 and 8 the numerals adjacent the curves indicate the number of the Example to which said curve pertains.

Depending on the quality of the molten metal and the treatment after manufacture, hollow particles of iron with the following characteristics can be produced according to the present invention.

1. Hollow particles of iron obtained from molten iron to which graphite has been added can be finished to an arbitrary carbon content in the range of 0 – 4% by hot-air drying followed by reduction and decarburization in an atmosphere of hydrogen gas, cracked ammonia gas, or an endothermic gas.

2. The hollow particles of iron as obtained from the molten iron to which graphite has been added possess a super-cooled texture with a Vickers hardness of Hv. 400 – 600, but through carbon adjustment by the treatment set forth in (1) and subsequent annealing their hardness can be brought within the hardness range of Hv. 80 – 500.

3. The hollow particles of iron obtained from molten iron alloyed with graphite, manganese, silicon, chromium and aluminum possess a Vickers hardness in the range of Hv. 500 – 700, but by means of the treatment set forth in (2) they can be brought within the hardness range of Hv. 100 – 700.

4. The hollow particles of iron obtained from an iron melt alone or from a mixture of molten iron and at least one constituent selected from the group consisting of graphite, manganese, silicon, chromium ahnd aluminum can be made more heat-resistant through decarburization by the treatment set forth in (1), followed by a vapour treatment, by means of which the particle surface can be coated with an iron film or an iron, manganese, silicon, chromium or aluminum oxide film.

The hollow particles of iron result from dropping the molten metal through a nozzle characterized by a slotted gap which provides at least an approximation of a plurality of individual converging jets of water. The viscosity, specific gravity and wall thickness of these particles depend on the relationship between the rate of water jet flow and the rate of flow of the molten metal, which is determined by the pressure, the quality of the molten metal, the melt temperature, and the crucible hole diameter.

Next, referring to the examples cited above, it will be described how the viscosity, specific gravity and wall thickness may be controlled by varying the nozzle and melt conditions of this invention.

TABLE 1

| Example | Manufacturing conditions | | | Spher. hollow particles | | | |
|---|---|---|---|---|---|---|---|
| | Composition of melt (in weight %) | Melting temp. | Crucible hole dia. | Annular slit (width) | Water jet pressure | Dia. mm | Wall thick.mm |
| 1 | Fe + G (5%) | 1800°C | 5 mm | 0.15 mm | 10 kg/cm² | 0.5–15 | 0.1–0.7 |
| 2 | Fe + G (5%) | 1800°C | 5 | 0.05 | 30 | 0.5–15 | 0.1–0.7 |
| 3 | Fe + G (5%) | 1800°C | 9 | 0.15 | 10 | 0.5–17 | 0.1–0.8 |
| 4 | Fe + G (5%) | 1800°C | 9 | 0.05 | 30 | 0.5–15 | 0.1–0.8 |
| 5 | Fe + G (3%) | 1650°C | 6 | 0.15 | 10 | 0.5–18 | 0.2–1.0 |
| 6 | Fe + G (3%) | 1650°C | 6 | 0.10 | 30 | 0.5–15 | 0.2–0.9 |
| 7 | Fe + Si (2.5%) + G (4%) | 1700°C | 5 | 0.30 | 5 | 0.5–15 | 0.1–0.6 |
| 8 | Fe + Mn (2%) + G (3%) | 1800°C | 5 | 0.15 | 10 | 0.5–17 | 0.2–1.0 |
| 9 | Fe + G (3%) + Si(2.5%)+P(0.5%) + S (0.1%) | 1550°C | 5 | 0.30 | 5 | 0.5–18 | 0.1–0.7 |
| 10 | Fe | 1850°C | 9 | 0.12 | 20 | 0.5–18 | 0.2–1.4 |

FIG. 6 shows the cumulative particle size distributions of the hollow particles of iron in the above Examples. FIG. 7 illustrates the relationship between the diameter and specific gravity of these hollow particles of iron. FIG. 8 illustrates the relationship between the diameter and wall thickness of these hollow particles.

1. If the molten metal is of the same quality, the size of the hollow particles of iron tends to increase with an increase in the diameter of the hole in the bottom of the crucible through which the molten metal is passed. This is illustrated by the curves in FIG. 6, which show Example 2 when a molten iron to which 5% graphite had been added was passed through a 5 mm hole in the crucible and Example 4 when the crucible hole diameter was 9 mm. If the crucible has the same hole diameter, the particle size tends to be greater as the pressure of the water jet from the nozzle becomes lower, This is illustrated by the curves in FIG. 6 showing Example 3 when the water pressure was 10 kg/cm$^2$ and Example 4 when it was 30 kg/cm$^2$.

Meanwhile, the particle size tends to be smaller as the viscosity of the molten metal is decreased by adding graphite, silicon, manganese, phosphorus or sulphur to iron or the temperature of the molten metal is increased. This is illustrated by comparing the curves in FIG. 6 showing Example 4 when a molten iron to which 5% graphite had been added was used and Example 10 when a pure iron melt was used. Examples 5 and 6 are cases in which the viscosity of the molten metal has been increased by lowering the graphite content to 3% and the temperature of the molten metal to 1650°C. It is seen that the particle size tends to be greater in Example 5 than in Example 1. In Example 7, a decrease in the temperature of the molten metal was made possible by adding 4% graphite and 2.5% silicon to the iron, thus increasing the viscosity of the molten metal, and hollow particles of iron with a similar particle size distribution to Example 1 were produced by impinging a water jet of a relatively low pressure, i.e., 5 kg/cm$^2$ on the molten metal. In Example 8, the graphite addition was reduced to 3%, but 2% manganese was added and thereby particles with a similar particle size distribution to Example 1 were obtained. Example 9 shows that even at a relatively low temperature of the molten metal, say, 1550°C, hollow particles of iron can be produced by adding 2.5% silicon and 1.5% phosphorus as well as 3% graphite to lower the viscosity of the molten metal; in this case, the addition of a little sulphur serves not only to reduce the viscosity of the melt, but also to generate $SO_2$ gas through reaction with the water jet in addition to the other generated gases, $H_2O$, $H_2$, $O_2$, CO and $CO_2$, thereby contributing to the expansion of the hollow particles. Example 10 shows the possibility of producing hollow particles of pure iron without the introduction of any additive elements. In this case of pure iron with a high viscosity of melt, the particle size distribution tends to be concentrated in a high diameter region as indicated by the curve in FIG. 6.

2. The specific gravity of hollow particles of iron differs depending on the diameter of the particle. This is because the wall thickness of the particle depends on the diameter of the particle. It will now be explained how, in accordance with the present invention, the specific gravity and wall thickness can be controlled for the same particle diameter.

In all these Examples, the greater the particle diameter, the lower the specific gravity of hollow particles of iron becomes, as illustrated in FIG. 7. This is because, as in all the examples the rate of wall thickness growth is lower than the rate of diameter increase. However, if the particle diameter is the same, as illustrated in FIG. 7 the specific gravity is the lowest for hollow particles obtained from a molten iron to which 5% graphite has been added, as in Examples 2 and 4 and is the highest for those obtained from the melt of pure iron in Example 10. The specific gravity of those particles obtained from a molten iron to which graphite, silicon, manganese, phosphorus and sulphur have been added comes midway between the values of Example 2 and Example 10, a typical case being represented by Example 8 illustrated in FIG. 7. FIG. 8 shows the wall thickness of the hollow particles of Examples 2, 4, 8 and 10 instead of the specific gravity of these particles shown in FIG. 7. As seen from these Examples, it is possible to facilitate expansion of hollow particles by lowering the viscosity of melt through the addition of graphite, silicon, manganese, phosphorus and sulphur to iron and by generating gases such as CO, $CO_2$, $SO_2$ etc. through the reaction between a jet of water on the one hand and graphite and sulphur on the other; and to reduce the specific gravity of the hollow particles for the same particle diameter by reducing their wall thickness. Even using a molten metal of the same quality, it is possible to control the specific gravity and wall thickness for the same particle size by adjusting the gap between the crucible hole diameter and the slotted slit of the nozzle.

The manufacturing process according to the present invention has the following advantages when applied to iron, i.e., the typical material.

1. Spherical hollow particles of iron or an iron alloy can be mass-produced.

2. The diameter, specific gravity and wall thickness of spherical hollow particles of iron or an iron alloy can be controlled.

3. The hardness of spherical hollow particles can be controlled through qualitative selection of the iron alloy.

4. It is difficult to make an aggregate of hollow particles of such conventional ceramic materials as carbon, alumina, glass or aluminum by simple heating and sintering, but the present invention makes it possible to produce an aggregate of a large number of spherical hollow particles of iron or an iron alloy by simple heating and sintering without use of any bonding agent.

5. It is possible to obtain a still firmer structure by joining together spherical hollow particles of iron or an iron alloy by means of a bonding agent or to fill the intercellular spaces within the bonded structure with a metal having a lower melting point than that of iron or with a high molecular material.

6. By changing the proportions of spherical hollow particles of iron or an iron alloy with different sizes, wall thicknesses and hardnesses, the compressive strength, shock-absorbing characteristic, heat insulation and weight of the bonded structure can be controlled.

By virtue of these features, the spherical hollow particles of iron or an iron alloy according to the present invention are found useful as material for manufacturing light-weight structures, as shock-absorbing material or as heat insulation material.

In the above description the specific material used for making spherical hollow particles has been iron and iron alloys, but the present invention is applicable also to Ni and Ni-alloys; Cu and Cu-alloys; Cr and Cr-alloys; Al and Al-alloys; or Zn and Zn-alloys. In other words, any ductile material which can be melted by heating and quenched (cooled) to harden can be employed to produce spherical hollow particles according to the present invention. Thus, all the principal metallic materials regardless of the kinds and contents of alloying elements are available for use in carrying out the present invention.

What is claimed is:

1. Method of manufacturing spherical hollow particles from molten metal which comprises the steps of a. ejecting a flow of water at a pressure of 5–30 kg/cm$^2$ through an annular gap defined between coaxial frustoconical inner and outer walls, one of which walls is provided with a plurality of slots 0.1–0.5 mm in width and spaced 0.1–1.0 mm apart, to form an inverted cone of jets converging at a common point below said annular gap, b. dropping a stream of said molten metal through said common point to shatter said stream into hollow metal particles containing entrapped water from said jets, which water is converted to a gaseous state by the heat of said metal so as to expand within said particles, and then c. cooling said particles until they are solidified in the form of hollow balls.

2. Method as claimed in claim 1 in which said metal is iron.

3. Method as claimed in claim 1 in which the metal is an alloy comprising iron and at least one alloying element selected from the group consisting of Ni 1–20%, Cu 1–10%, graphite 0.1–5%, silicon 0.1–5%, Mn 0.1–10%, Cr 0.1–5% and Al 0.005–3%.

4. Method as claimed in claim 1 in which said stream of metal is formed by passing said metal through a hollow core having an inner diameter of 2–10 mm.

5. Method as claimed in claim 1 in which said molten metal is at a temperature of 1500°C–2000°C, at the beginning of step (b).

6. Method as claimed in claim 1 in which said slots are 0.05–0.3 mm in depth.

7. Method as claimed in claim 6 in which the minimum width of said annular gap is 0.05–0.3 mm.

8. Method as claimed in claim 1 in which diametrically opposed sections of the inner wall of said gap lie at an angle of substantially 40° with respect to each other, while diametrically opposed segments of the outer wall of said gap lie at an angle of substantially 45° with respect to each other.

* * * * *